US005386751A

United States Patent [19]

Dylla et al.

[11] Patent Number: 5,386,751

[45] Date of Patent: Feb. 7, 1995

[54] METHOD AND APPARATUS FOR FORMING AND GRIPPING A WEB BEGINNING OF A REPLACEMENT ROLL

[75] Inventors: Norbert Dylla, Stadtbergen; Michael Wörner, Neusäss, both of Germany

[73] Assignee: MAN Roland Druckmaschinen AG, Offenbach, Germany

[21] Appl. No.: 37,973

[22] Filed: Mar. 23, 1993

[30] Foreign Application Priority Data

Apr. 10, 1992 [DE] Germany ..... 4212095

[51] Int. Cl.[6] ..... B26D 7/14; B26F 3/00

[52] U.S. Cl. ..... 83/18; 83/24; 83/53; 83/175; 83/177; 83/614; 83/649; 83/856; 225/93

[58] Field of Search ..... 83/14, 16, 18, 22, 53, 83/175, 152, 856, 924, 614, 649, 177, 24; 225/1, 23, 93, 101, 96; 242/56 R, 56 B, 58.1, 58.4, 78.8

[56] References Cited

U.S. PATENT DOCUMENTS

| | | | |
|---|---|---|---|
| 3,171,311 | 3/1965 | Carlson | 83/152 X |
| 4,210,043 | 7/1980 | Urion et al. | 83/175 |
| 4,249,438 | 2/1981 | Kelley | 83/53 |
| 4,308,774 | 1/1982 | Bohler et al. | 83/100 |
| 4,552,316 | 11/1985 | Dropczynski et al. | 242/56 R |
| 4,688,736 | 8/1987 | Brinker et al. | 242/78.8 X |
| 4,721,263 | 1/1988 | Miyazaki | 242/78.8 X |
| 4,821,971 | 4/1989 | Watanabe et al. | 242/78.8 X |

FOREIGN PATENT DOCUMENTS

| | | |
|---|---|---|
| 2938685A1 | 6/1980 | Germany . |
| 3918552A1 | 12/1990 | Germany . |
| 3811138C2 | 2/1992 | Germany . |

*Primary Examiner*—Eugenia Jones

*Attorney, Agent, or Firm*—Cohen, Pontani, Lieberman, Pavane

[57] ABSTRACT

A method and an apparatus for forming and gripping a beginning of a web of a replacement roll. At least one suction ledge is placed on an outer layer of the roll in a position in which the suction ledge extends parallel to the axis of the roll. The outer layer is raised by the suction ledge so that the outer layer is tensioned. The tensioned outer layer is cut parallel to and on the waste paper side of the suction ledge. Finally, the web beginning is lifted off by the suction ledge.

23 Claims, 5 Drawing Sheets

METHOD AND APPARATUS FOR FORMING AND GRIPPING A WEB BEGINNING OF A REPLACEMENT ROLL

BACKGROUND OF THE INVENTION

1. Field of the Invention

The present invention relates to a method and an apparatus for forming and gripping the front edge or beginning of a web of a replacement roll, as it is used in unwinding devices, for example, in rotary printing machines.

2. Description of the Related Art

DE 38 11 138 C2 shows a method and an arrangement for mechanically treating the end portion of rolled-up paper. In this arrangement, the replacement roll whose front edge is glued to the first web layer is clamped in the unwinding device of a paper-processing machine. Subsequently, a cutting device is placed against the outer surface of the decelerated replacement roll, and the cutting device is moved transversely in order to cut through several paper layers as waste. These layers are moved by means of air blowing pipe to a suction conveyor which grips the layers and moves them through rollers to a waste paper receiving device.

The above-described construction is expensive because it utilizes complicated mechanisms. In addition, the method of gripping several layers with a suction conveyor is not safe. The same is true for the further transport of the layers. Finally, since inevitably several layers of the replacement roll are cut through, the amount of waste paper is increased.

An arrangement in which only one layer of the replacement roll is cut is known from DE 39 18 552 A1. However, this arrangement requires a specific configuration of the end of the roll glue to the outer layer and a specific positioning of the roll. This arrangement is expensive because it requires complicated mechanisms for cutting, for positioning the roll, and for gripping the beginning of the web.

SUMMARY OF THE INVENTION

Therefore, it is the primary object of the present invention to provide a method which reliably forms and grips the front edge or beginning of the web of a replacement roll by using an uncomplicated arrangement and producing at most only one layer of waste paper. In addition, an apparatus for carrying out this method is also provided.

In accordance with the present invention, the method forming and gripping a beginning of the web of a replacement roll includes placing at least the one suction ledge against the outer layer of the replacement roll in a position extending parallel to the axis of the roll, raising the outer layer by means of the suction ledge, so that the outer layer is tensioned, and cutting the tensioned outer layer adjacent the suction ledge and raising the suction ledge together with the outer layer.

The apparatus for carrying out the method includes at least one suction ledge which can be moved against the outer layer of the replacement roll parallel to the axis of the roll and perpendicular to the outer surface of the roll. A web cutting device is arranged next to the at least one suction ledge.

Since, in accordance with the invention, the outer layer is lifted before it is being cut, it is ensured that no additional layers are damaged and the amount of waste paper is minimized. Simultaneously, the outer layer is tensioned, so that no additional auxiliary elements are required for assisting in the cutting procedure. It is not necessary to prepare the replacement roll for carrying out the method, and the front edge or beginning of the web is available in the gripped state without requiring additional method steps. The outer layer has to be gripped only once, and only one layer has to be gripped. In addition, a straight cut can be carried out in a simple manner, and the resulting straight web beginning can be handled in an advantageous manner. Thus, the method according to the present invention is altogether simple and reliable, and the arrangement for carrying out the method is inexpensive.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The present invention is further described in detail below with reference to the accompanying drawing, in which.

DESCRIPTION OF THE PRESENTLY PREFERRED EMBODIMENTS

Figure 1:
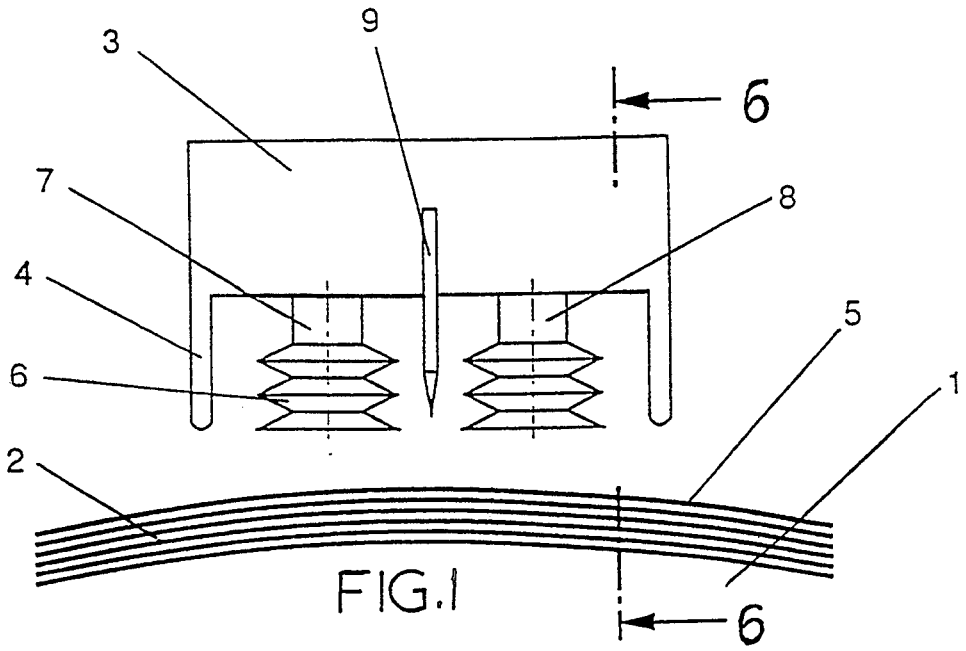
FIGS. 1–5 are schematic side views showing the arrangement according to the present invention in different stages of operation.
Figure 11:
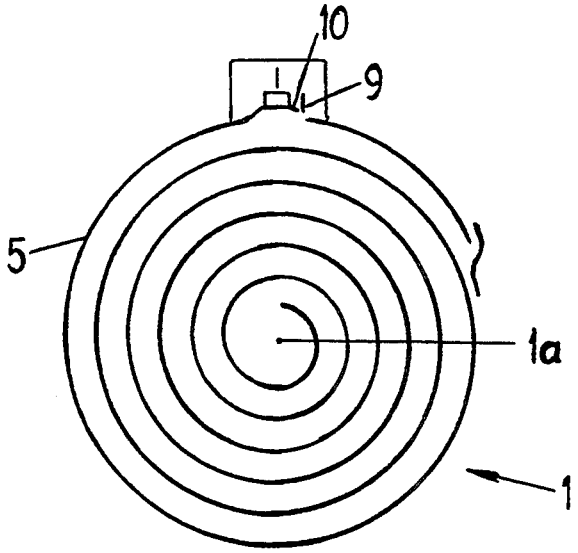
FIG. 11 schematically shows a replacement roll with the inventive apparatus mounted thereon.

FIG. 1 of the drawing shows only the outer layers 2 of a replacement roll 1. The roll beginning, not shown, is glued against the uppermost layer. For example, the replacement roll 1 can be mounted to be readily available in a position axially aligned with an unwinding device. FIG. 11 shows a cross-section of the roll 1 and its axis 1*a*.

Figure 2:
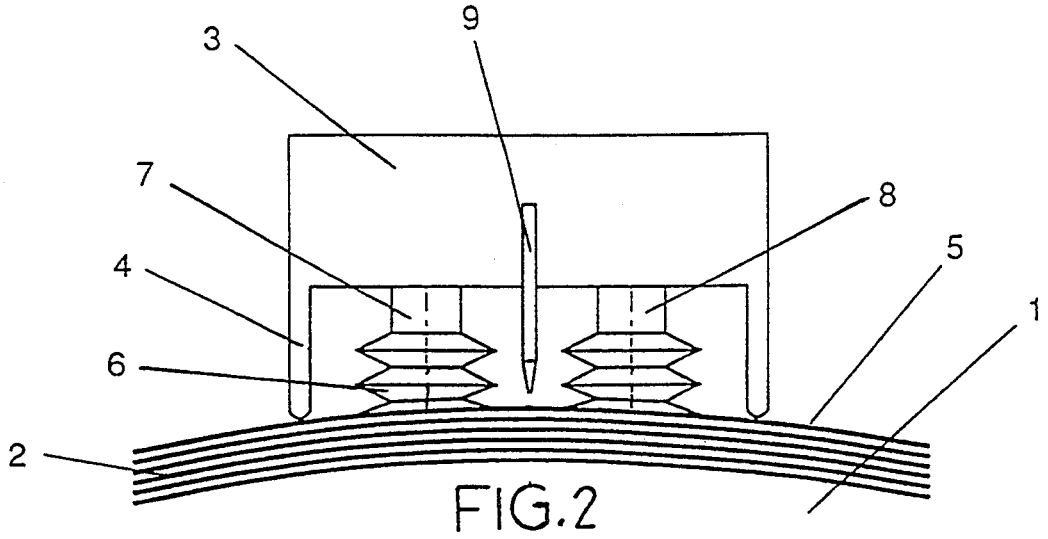
Figure 6:
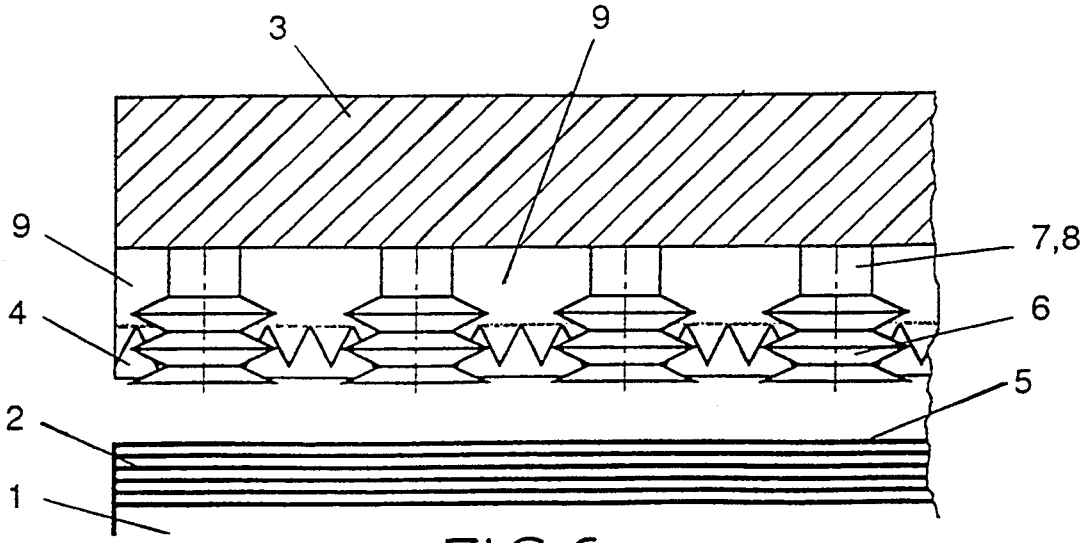
FIG. 6 is a sectional view taken along sectional line A—A of FIG. 1.

A base member 3 with support arms 4 is moved from a position of rest toward the replacement roll 1 until the support arms 4 rest on the outer web layer 5 of the roll. The base member 3 extends over the entire width of the roll, as can be seen in FIG. 6, and has two suction ledges 7, 8 which are composed of bellows-type suction grip members 6. A serrated knife 9 is mounted between the two suction ledges 7, 8. In the position illustrated in FIG. 2, the knife 9 does not contact the outer layer 5.

Figure 3:
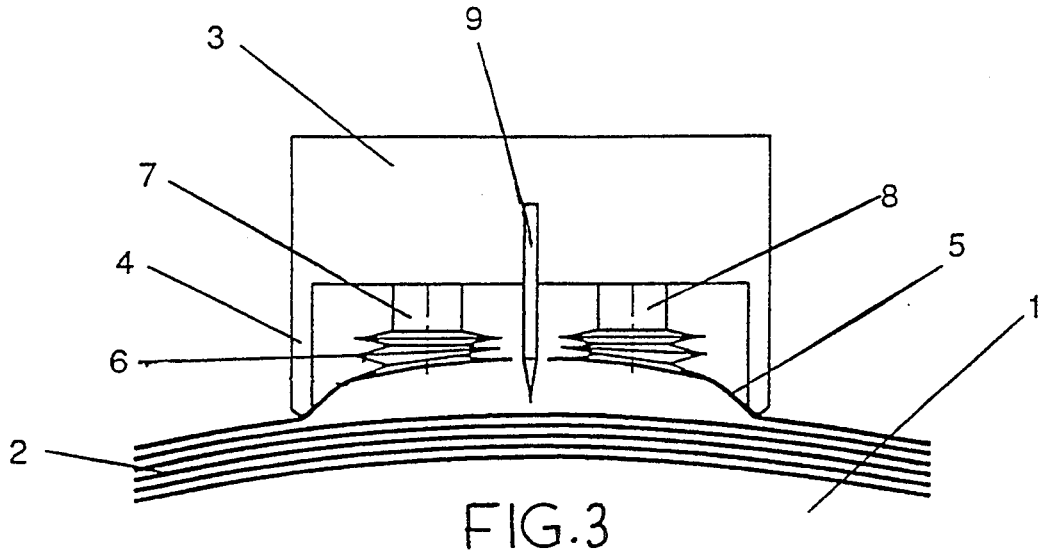
Figure 4:
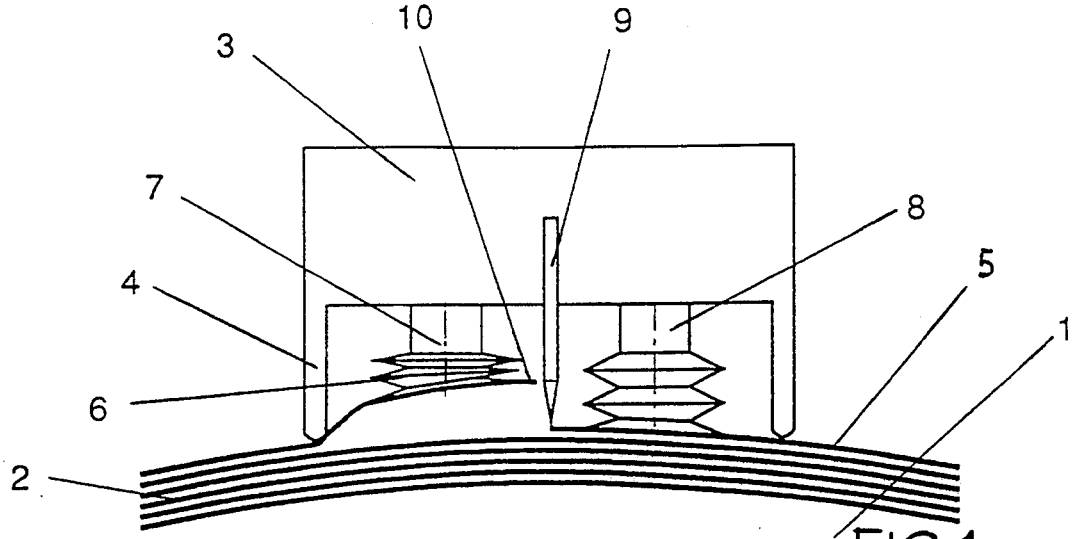
Figure 5:
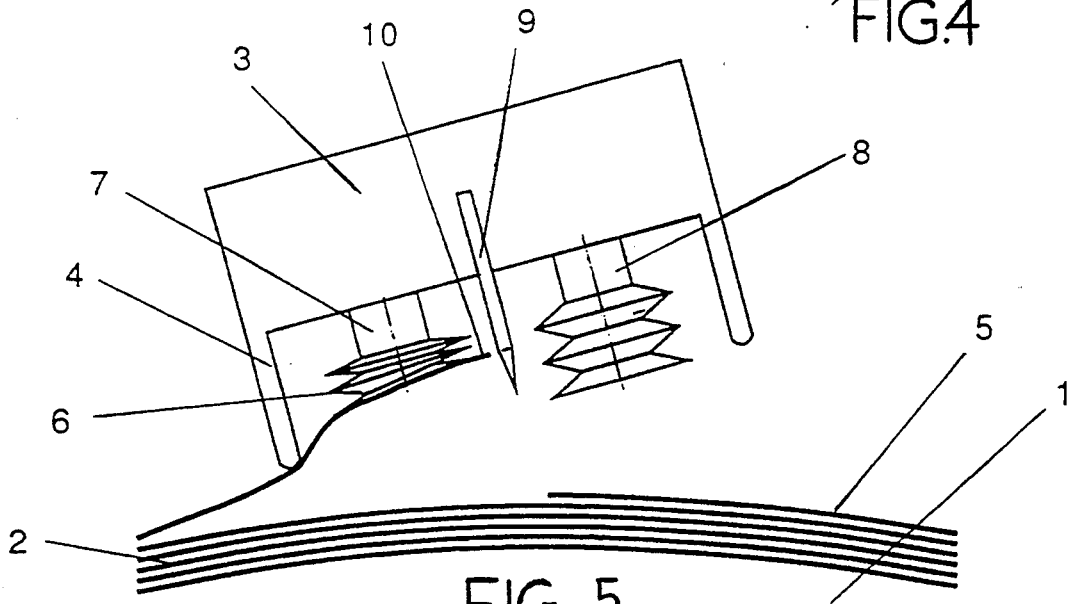

As illustrated in FIG. 3, when the suction ledges 7, 8 are activated by means of suction air, the bellows-type suction grip members 6 are contracted, and the outer layer 5 is raised in the area between the support arms 4. As a result, the outer layer 5 is tensioned, makes contact with the knife 9, and is being cut. Subsequently, as illustrated in FIG. 4, the suction ledge 8 is deactivated. This suction ledge 8 is located on that side of the knife 9 where the waste paper is produced, i.e., the suction ledge 8 holds the beginning of the roll which has been cut off. As a result, the waste paper piece at the beginning of the roll is released. On the other hand, as shown in FIGS. 4 and 5, the suction ledge 7 pulls off the outer layer 5 with the newly created web beginning 10 when the base member 3 is subsequently moved away from the replacement roll 1.

In the illustrated embodiment, as shown in FIG. 6, a serrated knife is used. In this case, the suction grip members can be activated simultaneously over the entire length of the suction ledges. However, it is also possible to use a knife which is not serrated. In this case, in order to reduce the temporary cutting force, i.e. , the required pulling force of the suction grip members, the suction grip members should be activated beginning at one side of the replacement roll continuously progressing over the width of the roll, or the suction grip members should be activated in successive sections. It is also possible to place a knife directly on the outer layer if the contact force is limited to such an extent that the outer layers of the roll are not severed or damaged. Moreover, it is also possible to omit the support arms of the base member if the outermost layer of the roll is glued to the next layer. If this is not the case, the support arms are required for tensioning the outer layer raised from the next layer and for moving the outer layer in the tensioned state against the web cutting device. Instead of providing a knife which extends over the entire width of the roll, it is also possible to use a blade which is moved by means of a linear drive transversely of the replacement roll and to cut the raised outer layer in this manner.

Figure 7:
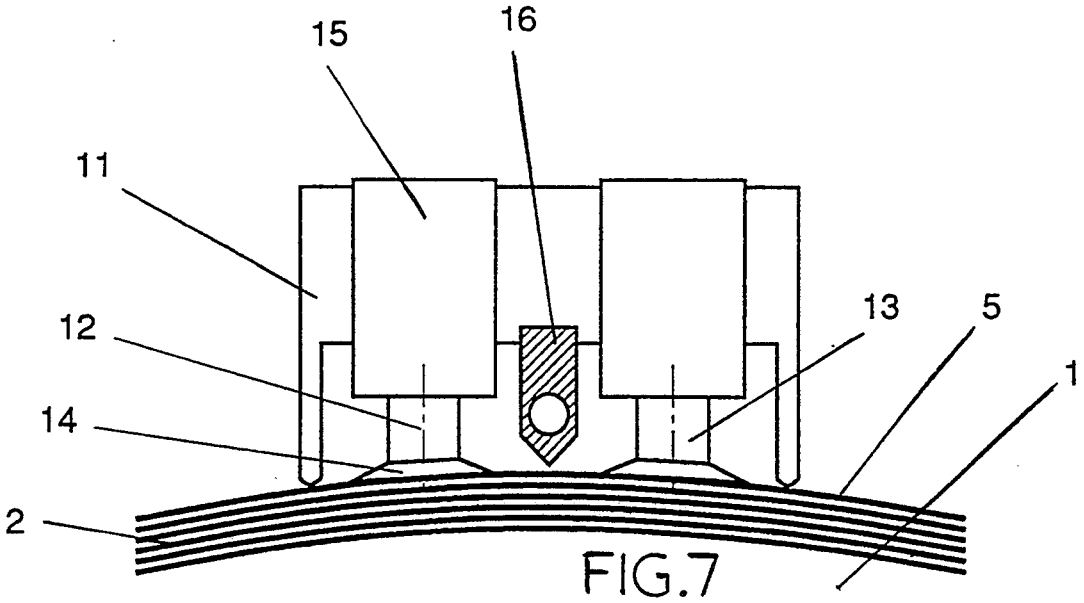
FIGS. 7–8 are schematic side views of another embodiment of the invention with suction grip members with movable holders and an undercooled rail.
Figure 8:
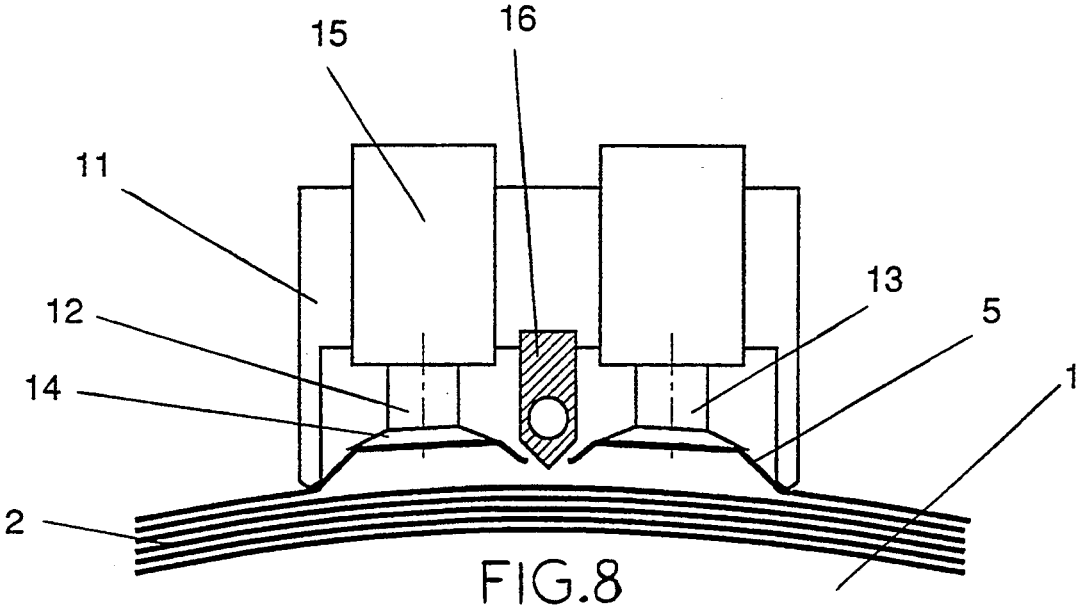

Additional embodiments of the suction grip members and the web cutting device are shown in FIGS. 7–10. In the embodiment of FIG. 7, suction ledges 12, 13 are mounted on a base member 11, wherein the suction ledges 12, 13 are composed of suction grip members 14 with movable holders 15. An undercooled rail 16 serving as the web cutting device is placed between the suction ledges 12, 13. As illustrated in FIG. 8, the holders 15 raise the outer layer 5 by means of a suitable drive and move it against the undercooled rail 16. The rail 16 is undercooled by means of a cooling medium flowing through the rail to a temperature which is below the dew point of the ambient air. As a result, condensate accumulates on the rail 16 and moistens the raised outer paper layer 5. This substantially reduces the tensile strength of the paper layer, and the layer ruptures.

Figure 9:
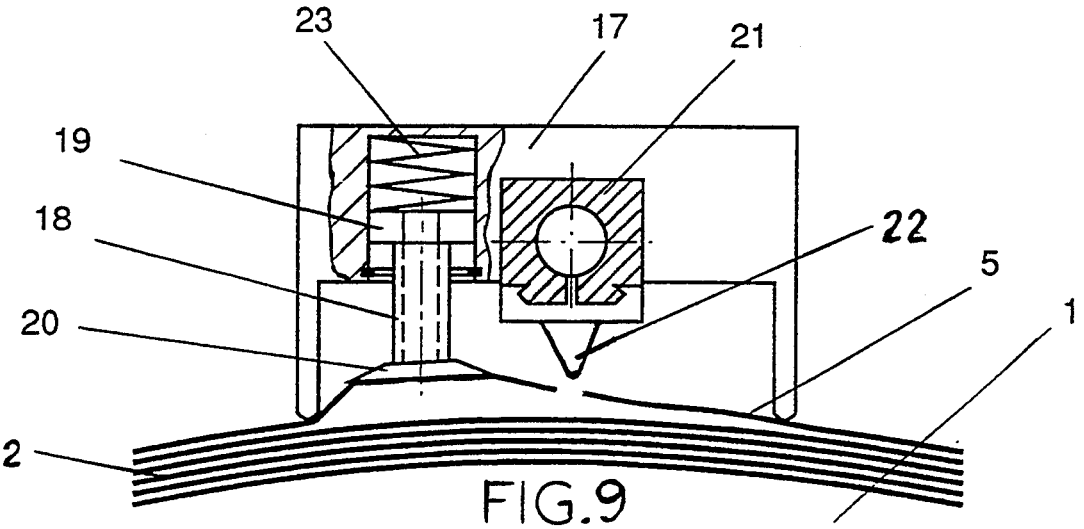
FIG. 9 is a schematic side view of another embodiment with only a single suction ledge with piston-type grip members and a longitudinally movable liquid nozzle.

FIG. 9 of the drawing shows a base member 17 with only one suction ledge 18 which is composed of suction grip members 20 suspended from pistons 19. On the side of the suction ledge 18 on which waste paper is produced, a linear drive with linear guide 21 is arranged. The linear guide 21 has a nozzle 22. When the suction grip members 20 are activated, the negative pressure has the result that the piston 18 is pulled into the base member 17 against the force of a spring 23, and the outer paper layer 5 is lifted. In this position, as illustrated in FIG. 9, there is still a distance between the nozzle 22 and the outer layer 5. The nozzle 22 now ejects a thin jet of liquid and is simultaneously moved, by means of the linear drive 21, across the raised outer layer 5, so that the outer layer 5 is softened and ruptures where the liquid jet has been applied.

Figure 10:
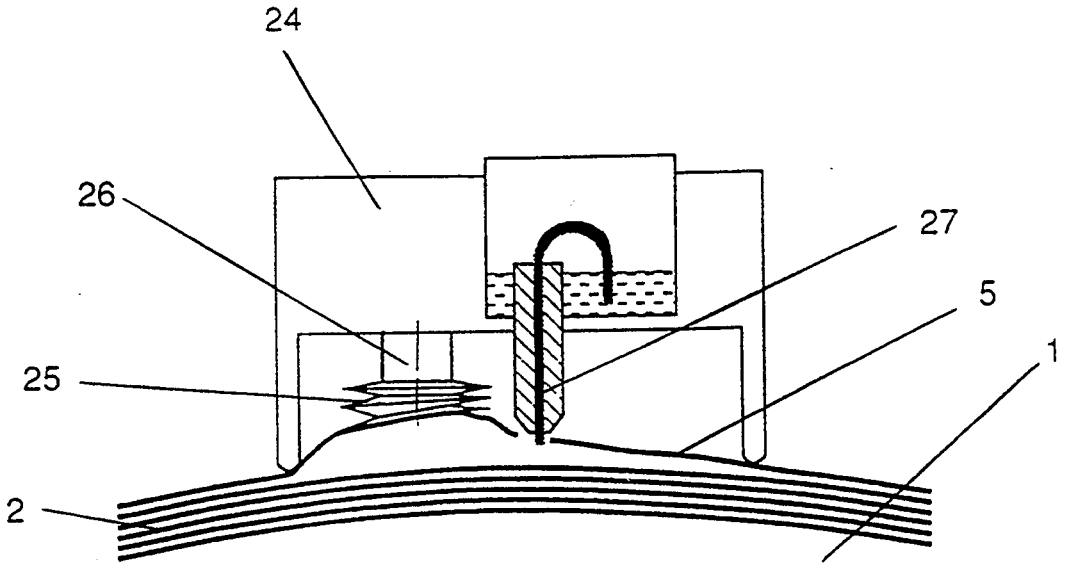
FIG. 10 is a schematic side view of another embodiment with a suction ledge with bellows-type suction grip members and a capillary-type ledge.

FIG. 10 of the drawing shows a base member 24 with a suction ledge 26 with bellows-type suction grip members 25. A capillary ledge 27 is arranged next to the suction ledge 26 on the side where the waste paper is produced. The capillary ledge 27 is in communication with a liquid reservoir. In the raised state, the outer layer 5 makes contact with the capillary ledge 27, so that the outer layer 5 is moistened and ruptures. The capillary ledge also may have a short length and may be moved by means of a linear drive across the raised outer layer 5.

Figure 12:
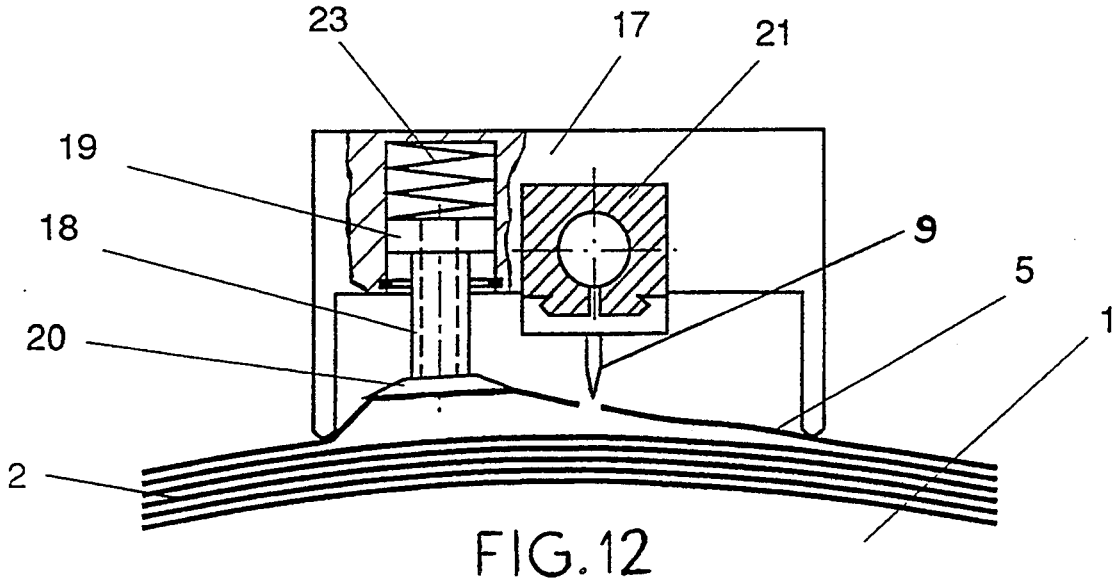
FIG. 12 is a view similar to FIG. 9 of another embodiment of the invention.

FIG. 12 of the drawing is similar to FIG. 9, with the exception that a knife 9 is connected to the linear guide 21 for cutting the outer paper layer 5.

It should be understood that the preferred embodiments and examples described are for illustrative purposes only and are not to be construed as limiting the scope of the present invention which is properly delineated only in the appended claims.

We claim:

1. A method of forming and gripping a new beginning of a web of a replacement roll including an outer web layer and having an axis, the method comprising the steps of: a) providing a support having support arms directed at the replacement roll; b) arranging at least one suction ledge on the support between the support arms; c) placing the at least one suction ledge and the support arms on the outer layer so that the suction ledge extends parallel to the axis of the roll, the suction ledge having a first side in close proximity to one of the support arms of the support and an oppositely directed second side; d) raising the outer layer with the suction ledge, so that the outer layer is tensioned; e) cutting the tensioned outer layer parallel to the suction ledge on the second side of the suction ledge; and f) lifting off the outer layer with the suction ledge, steps d)–f) being carried out between the support arms of the support.

2. The method according to claim 1, further comprising placing an additional suction ledge on the outer layer in a position extending parallel to the at least one suction ledge and located on the opposite side of the at least one suction ledge, wherein the step of raising the outer layer is carried out by the at least one suction ledge and the additional suction ledge, and wherein the step of cutting the tensioned outer layer is carried out between the suction ledges, and deactivating the additional suction ledge after cutting.

3. The method according to claim 2, wherein the cutting step is carded out by raising the outer layer against a knife.

4. The method according to claim 3, wherein the roll has a width, further comprising cutting the outer layer continuously along the width of the roll.

5. The method according to claim 3, wherein the roll has a width, further comprising cutting the outer layer over successive portions along the width of the roll.

6. The method according to claim 2, wherein the roll has a width, comprising cutting the outer layer simultaneously over the entire width of the roll.

7. The method according to claim 1, wherein the cutting step is carried out by raising the outer layer against a knife.

8. The method according to claim 7, wherein the roll has a width, further comprising cutting the outer layer continuously along the width of the roll.

9. The method according to claim 7, wherein the roll has a width, further comprising cutting the outer layer over successive portions along the width of the roll.

10. The method according to claim 7, wherein the roll has a width, comprising cutting the outer layer simultaneously over the entire width of the roll.

11. An apparatus for forming and gripping a new beginning of a web of a replacement roll including an outer web layer and having an axis, the apparatus comprising: at least one suction ledge; means for moving the suction ledge into contact with the outer web layer in a position in which the suction ledge extends parallel to the axis of the roll, the suction ledge having a first side and an oppositely directed second side; a web cutting device mounted adjacent the second side of the suction ledge; and a base member, the suction ledge and the web cutting device being mounted on the base member, the base member having support arms directed toward the roll and arranged outside the suction ledge and the web cutting device, the support arms being dimensioned such that they contact the outer layer when the suction ledge contacts the outer layer, the web cutting device being dimensioned such that it is spaced from the outer layer when the support arms contact the outer layer, the first side of the suction ledge being in close proximity to one of the support arms of the base member.

12. The apparatus according to claim 11, further comprising an additional suction ledge, means for moving the additional suction ledge into contact with the outer layer into a position located adjacent the web cutting device.

13. The apparatus according to claim 12, wherein the web cutting device is a knife mounted between the suction ledges.

14. The apparatus according to claim 13, wherein the base member further comprises a linear drive and a linear guide for the drive extending parallel to the axis of the roll, the knife being mounted on the linear drive.

15. The apparatus according to claim 11, wherein the suction ledge comprises a plurality of bellows-type suction grip members.

16. The apparatus according to claim 11, wherein the suction ledge comprises a plurality of movable holders, and suction grip members mounted on the holders.

17. The apparatus according to claim 11, wherein the suction ledge comprises a plurality of pistons, and suction grip members mounted on each piston.

18. The apparatus according to claim 11, wherein the web cutting device is a knife, the apparatus further comprising a device for moving the knife against the outer layer.

19. The apparatus according to claim 11, wherein the web cutting device is a device for moistening the outer layer of the roll.

20. The apparatus according to claim 19, wherein the moistening device is a cooled rail.

21. The apparatus according to claim 19, wherein the moistening device is a capillary ledge connected to a liquid reservoir.

22. The apparatus according to claim 19, wherein the base member further comprises a linear drive and a linear guide for the drive extending parallel to the axis of the roll, the moistening device being mounted on the linear drive.

23. The apparatus according to claim 22, wherein the moistening device mounted on the linear drive comprises a nozzle.

* * * * *